US009546566B2

(12) United States Patent
Guedou et al.

(10) Patent No.: US 9,546,566 B2
(45) Date of Patent: Jan. 17, 2017

(54) PART COMPRISING A COATING ON A SUPERALLOY METAL SUBSTRATE, THE COATING INCLUDING A METAL UNDERLAYER

(75) Inventors: Jean-yves Guedou, Le Mee sur Ceine (FR); Mathieu Boidot, Toulouse (FR); Claude Estournes, Rieumes (FR); Daniel Monceau, Nailloux (FR); Djar Oquab, Mons (FR); Serge Selezneff, Issy les Moulineaux (FR)

(73) Assignees: SNECMA, Paris (FR); Centre National de la Recherche Scientifique, Paris (FR)

( * ) Notice: Subject to any disclaimer, the term of this patent is extended or adjusted under 35 U.S.C. 154(b) by 91 days.

(21) Appl. No.: 14/114,680

(22) PCT Filed: Apr. 24, 2012

(86) PCT No.: PCT/FR2012/050890

§ 371 (c)(1),
(2), (4) Date: Oct. 29, 2013

(87) PCT Pub. No.: WO2012/146864

PCT Pub. Date: Nov. 1, 2012

(65) Prior Publication Data

US 2014/0050940 A1 Feb. 20, 2014

(30) Foreign Application Priority Data

Apr. 29, 2011 (FR) ..... 11 53678

(51) Int. Cl.
*B32B 15/01* (2006.01)
*F01D 25/00* (2006.01)
(Continued)

(52) U.S. Cl.
CPC ..... *F01D 25/005* (2013.01); *C23C 10/00* (2013.01); *C23C 28/321* (2013.01);
(Continued)

(58) Field of Classification Search
None
See application file for complete search history.

(56) References Cited

U.S. PATENT DOCUMENTS 4,495,252 A 1/1985 O'Brien et al.
6,838,191 B1 1/2005 Raj
(Continued)

FOREIGN PATENT DOCUMENTS

EP 1 767 666 3/2007
FR 2 289 625 5/1976
(Continued)

OTHER PUBLICATIONS

International Search Report Issued Jun. 15, 2012 in PCT/FR12/50890 Filed Apr. 24, 2012.
(Continued)

*Primary Examiner* — Daniel J Schleis
(74) *Attorney, Agent, or Firm* — Oblon, McClelland, Maier & Neustadt, L.L.P.

(57) ABSTRACT

The invention relates to a part comprising a coating on a superalloy metal substrate, the coating comprising a metal underlayer covering said substrate, the part being characterized in that said metal underlayer contains a base of nickel aluminide and also contains 0.5 at % to 0.95 at % of one or more stabilizer elements M from the group formed by Cu and Ag for stabilizing the gamma and gamma prime phases.

18 Claims, 4 Drawing Sheets

(51) Int. Cl.

| | |
|---|---|
| ***C23C 10/00*** | (2006.01) |
| ***C23C 30/00*** | (2006.01) |
| ***C23C 28/00*** | (2006.01) |

(52) U.S. Cl.

CPC ..... *C23C 28/3455* (2013.01); *C23C 30/00* (2013.01); *Y10T 428/12618* (2015.01); *Y10T 428/12944* (2015.01)

(56) References Cited

U.S. PATENT DOCUMENTS

| | | | | |
|---|---|---|---|---|
| 7,045,094 | B2 * | 5/2006 | Axenov et al. ..... | 420/532 |
| 2007/0071996 | A1 | 3/2007 | Hazel et al. | |
| 2010/0012235 | A1 * | 1/2010 | Gleeson et al. ..... | 148/675 |

FOREIGN PATENT DOCUMENTS

| | | |
|---|---|---|
| FR | 2 473 417 | 7/1981 |
| FR | 2 941 967 | 8/2010 |
| WO | WO 2008/010965 | 1/2008 |

OTHER PUBLICATIONS

Office Action in corresponding United Kingdom application GB1320147.0, received Aug. 18, 2016.

* cited by examiner

PART COMPRISING A COATING ON A SUPERALLOY METAL SUBSTRATE, THE COATING INCLUDING A METAL UNDERLAYER

The invention relates to a part comprising a coating on a substrate, the coating including a metal underlayer covering said substrate.

Such a part is in particular a metal part that is required to withstand high levels of mechanical and thermal stress in operation, and in particular a part with a superalloy substrate. Such a thermomechanical part constitutes in particular a part of an aviation or terrestrial turbine engine. Said part may in particular constitute a blade or a vane or a nozzle for a turbine of a turbine engine, and in particular of a turbojet or a turboprop for an airplane.

The search for increased efficiency in turbine engines, in particular in the field of aviation, and the search to reduce fuel consumption and polluting emissions of gas and non-burned residues have led to coming closer to stoichiometric combustion of the fuel. This situation is accompanied by an increase in the temperature of the gas leaving the combustion chamber on its way to the turbine.

At present, the temperature limit for using superalloys is about 1100° C., with the temperature of the gas at the outlet from the combustion chamber or at the inlet to the turbine possibly being as high as 1600° C.

Consequently, it has been necessary to adapt the materials of the turbine to this high temperature by improving techniques for cooling turbine blades and vanes (hollow blades and vanes) and/or improving the high-temperature strength properties of such materials. This second technique, in combination with using superalloys based on nickel and/or on cobalt, has led to several solutions including depositing a thermally insulating coating referred to as a thermal barrier that is made up of a plurality of layers on the superalloy substrate.

Over the last thirty years, the use of thermal barriers in aeroengines has become general practice and it enables the gas inlet temperature to turbines to be increased, the flow rate of cooling air to be reduced, and thus the efficiency of engines to be improved.

This insulating coating serves to create a temperature gradient through the coating on a part that is being cooled during steady operating conditions, with the total amplitude of the temperature gradient possibly exceeding 100° C. for a coating having a thickness of about 150 micrometers (μm) to 200 μm and presenting conductivity of 1.1 watts per meter per kelvin ($W.m^{-1}.K^{-1}$). The operating temperature of the underlying metal forming the substrate for the coating is thus decreased by the same gradient, thereby leading to significant savings in the volume of cooling air needed and in the specific consumption of the turbine engine, and also leading to a longer lifetime for the part.

It is known to have recourse to using a thermal barrier that comprises a layer of ceramic based on yttrium oxide stabilized zirconia, i.e. yttria-stabilized zirconia having a molar content of yttrium oxide lying in the range 4% to 12% (and in particular 6% to 8%), presenting a coefficient of expansion that is different from that of the superalloy constituting the substrate, and presenting thermal conductivity that is quite low. The stabilized zirconia may also sometimes contain at least one oxide of an element selected from the group constituted by the rare earths, and preferably from the following subgroup: Y (yttrium), Dy (dysprosium), Er (erbium), Eu (europium), Gd (gadolinium), Sm (samarium), Yb (ytterbium), or a combination of an oxide of tantalum (Ta), and at least one rare earth oxide, or with a combination of an oxide of niobium (Nb) and at least one rare earth oxide.

Among the coatings used, mention is made of the fairly generalized use of a layer of ceramic based on zirconia that is partially stabilized with yttrium oxide, e.g. $Zr_{0.92}Y_{0.08}O_{1.96}$.

In order to anchor this ceramic layer, a metal underlayer having a coefficient of expansion that ideally is close to that of the substrate, is generally interposed between the substrate of the part and the ceramic layer. In this way, the metal underlayer serves firstly to reduce stresses due to the difference between the coefficients of thermal expansion of the ceramic layer and of the substrate-forming superalloy.

This underlayer also provides adhesion between the substrate of the part and the ceramic layer, it being understood that adhesion between the underlayer and the substrate of the part takes place by inter-diffusion, while adhesion between the underlayer and the ceramic layer takes place by mechanical anchoring and by the propensity of the underlayer at high temperature to develop a thin oxide layer at the ceramic and underlayer interface, which oxide layer serves to provide chemical contact with the ceramic.

In addition, this metal underlayer provides the superalloy of the part with protection against corrosion and oxidation phenomena (the ceramic layer is permeable to oxygen).

In particular, it is known to use an underlayer constituted by a nickel aluminide including a metal selected from platinum, chromium, palladium, ruthenium, iridium, osmium, rhodium, or a mixture of these metals, and/or a reactive element selected from zirconium (Zr), cerium (Ce), lanthanum (La), titanium (Ti), tantalum (Ta), hafnium (Hf), silicon (Si), and yttrium (Y).

For example, a coating of the (Ni,Pt)Al type is used in which the platinum is in insertion in the nickel lattice of the β-NiAl intermetallic compounds. The platinum is deposited electrolytically prior to thermochemical aluminization treatment.

Under such circumstances, this metal underlayer may be constituted by a platinum-modified nickel aluminide NiPtAl using a metal comprising the following steps: preparing the surface of the part by chemical etching and sand blasting; electrolytically depositing a platinum (Pt) coating on the part; optionally applying heat treatment to the resulting assembly to cause the Pt to diffuse into the part; depositing aluminum (Al) by chemical vapor deposition (CVD) or by physical vapor deposition (PVD); optionally heat treating the resulting assembly to cause Pt and Al to diffuse into the part; preparing the surface of the resulting metal underlayer; and depositing a ceramic coating by electron beam physical vapor deposition (EB-PVD).

In conventional manner, said underlayer is constituted by an alloy suitable for forming a protective alumina layer by oxidation: in particular, using a metal underlayer that includes aluminum gives rise by natural oxidation in air to a layer of alumina $Al_2O_3$ that covers all of the underlayer. The purity and the growth rate of the oxide layer at the interface is a parameter that is very important in controlling the lifetime of the thermal barrier system.

Usually, the ceramic layer is deposited on the part to be coated either by a spray technique (in particular plasma spraying) or by physical or chemical vapor deposition, i.e. by evaporation (e.g. using EB-PVD to form a coating deposited in an evacuated evaporation enclosure under electron bombardment).

With a spray coating, a zirconia-based oxide is deposited using plasma spray type techniques under a controlled atmosphere, thus leading to a coating being formed that is constituted by a stack of molten droplets that have been impact-quenched, flattened, and stacked so as to form an imperfectly-densified deposit of thickness generally lying in the range 50 μm to 1 millimeter (mm).

A coating deposited by a physical technique, e.g. by electron beam evaporation, gives rise to a coating made up of an assembly of columns that are oriented substantially perpendicularly to the surface for coating, over a thickness lying in the range 20 μm to 600 μm. Advantageously, the space between the columns enables the coating to compensate effectively the thermomechanical stresses that, at operating temperatures, are due to the differential expansion relative to the substrate.

Parts are thus obtained that present lifetimes that are long while they are being subjected to high-temperature thermal fatigue.

Conventionally, such thermal barriers thus constitute a thermal conductivity discontinuity between the outer coating of the mechanical part, which forms the thermal barrier, and the substrate of the coating, which forms the material constituting the part.

Nevertheless, standard present-day thermal-barrier systems present certain limits, including the following:

- because the oxidation resistance of first-generation substrates of the AM1 and/or AM3 type is not optimized in terms of the ability of the thermal-barrier system to withstand spalling, it is necessary to use an attachment underlayer that withstands high temperature oxidation under thermomechanical cycling conditions. A first-generation superalloy of the "AM1" type presents the following composition in percentages by weight: 5% to 8% Co; 6.5% to 10% Cr; 0.5% to 2.5% Mo; 5% to 9% W; 6% to 9% Ta; 4.5% to 5.8% Al; 1% to 2% Ti; 0 to 1.5% Nb; C, Zr, B, each less than 0.01%: the balance to 100% being constituted by Ni;
- the relative fragility of the metal underlayer as from a certain temperature (e.g. the β-(Ni,Pt)Al metal underlayer presents a ductile-brittle phase transition at a temperature of about 700° C.): for high levels of mechanical stress, premature cracking occurs in the underlayer, which then propagates into the substrate and leads to the part deforming, or indeed to the part breaking;
- the lack of microstructure stability in the attachment underlayer during use at high temperature. Interdiffusion between the underlayer and the superalloy leads to the β-(Ni,Pt)Al coating being transformed into martensite and then into γ-Ni and γ'-$Ni_3Al$.

In the prior art, in order to improve the ability of the thermal-barrier system to withstand oxidation, proposals have been made to add hafnium (Hf) in the substrate or directly in the composition of the metal underlayer. It is known that hafnium improves the ability of the system to withstand oxidation, but that it also serves to reduce significantly damage at the interface between the metal underlayer and the substrate (reference: "Effect of Hf, Y and C in the underlying superalloy on the rumpling of diffusion aluminide coatings"—Acta Materialia, Volume 56, Issue 3, February 2008, pp. 489-499, V. K. Tolpygo, K. S. Murphy, D. R. Clarke). Nevertheless, although it has proved to be effective, adding hafnium presents a significant risk since precipitates may form in the metal underlayer during deposition such that the hafnium can no longer perform its role of providing protection against oxidation. Furthermore, it should be observed that depositing hafnium by physical vapor deposition techniques presents a relatively high cost.

In the prior art, in order to improve the thermomechanical strength of the part, proposals have been made to vary the chemical composition of the substrate, in particular by adding several percent of Re (Rhenium), in particular in the range 3% to 6%.

Efforts have been devoted mainly to chemical optimization of the metal substrate and very little work has been carried out simultaneously on the substrate and metal underlayer pair.

Thus, until now no solution has made it possible to improve both the ability of the substrate to withstand oxidation and also the thermomechanical strength of the part, without the improvement in one of these aspects being detrimental to the other aspect.

An object of the present invention is to provide a coating that makes it possible to overcome the drawbacks of the prior art, and in particular that provides the possibility of improving the thermomechanical strength of the metal underlayer of the thermal barrier.

In addition, when the coating includes a ceramic layer on the metal underlayer, the lifetime of the thermal barrier with respect to spalling should also be improved by reinforcing the oxidation-withstanding properties of the metal underlayer and by conserving a low-roughness surface state for longer during thermal cycling.

To this end, the present invention provides a part comprising a coating on a superalloy metal substrate, the coating comprising a metal underlayer covering said substrate, the part being characterized in that said metal underlayer contains a base of nickel aluminide and also contains 0.5 atomic percent (at %) to 0.95 at % of one or more stabilizer elements M from the group formed by Cu and Ag for stabilizing the gamma and gamma prime phases.

It can thus be understood that in the invention provision is made for a total presence lying in the range 0.5 at % to 0.95 at % of one or more stabilizer elements M for stabilizing the gamma and gamma prime phases, these elements being selected from the group formed by Cu and Ag, i.e. 0.5 at % to 0.95 at % of Cu only, or of Ag only, or of a mixture of both.

The inventors have found that with such a modification for the composition of the metal underlayer, a metal underlayer is obtained that is much more stable over time (withstands oxidation better and maintains its microstructure better), that is a better crystallographic match with the superalloy substrate (γ and γ' phases of the metal underlayer), and with a coefficient of thermal expansion that is closer to that of the superalloy, and that is less subjected to interdiffusion.

This solution also presents the additional advantage of reducing the rate at which the underlayer oxidizes.

Furthermore, it is found that by means of this composition, the metal underlayer is less subjected to the formation of defects and thus conserves for longer a surface state with low roughness at its top surface or surface forming an interface with the ceramic layer, thereby contributing to increasing the lifetime of the coating.

Overall, by means of the solution of the present invention, it is possible to make a coating that presents a longer service lifetime.

Preferably, said metal underlayer includes as its stabilizing element M only Ag in the range 0.5 at % to 0.95 at %. Preferably, this single stabilizer element Ag is present at a content lying in the range 0.6 at % to 0.9 at %, and preferably at a content lying in the range 0.7 at % to 0.85 at %.

Preferably, said metal underlayer includes as its stabilizing element M only Cu in the range 0.5 at % to 0.95 at %.

Preferably, this single stabilizer element Cu is present with a content in the range 0.6 at % to 0.9 at %, and preferably with a content in the range 0.7 at % to 0.85 at %.

In another preferred provision, said metal underlayer also contains platinum group elements in the range 2 at % to 30 at %, and preferably in the range 15 at % to 25 at %, so as to form a metal underlayer with an NiPtAl type base.

The term "platinum group metal" is used to mean platinum, palladium, iridium, osmium, rhodium, or ruthenium.

Preferably, said metal underlayer also contains at least one of the reactive elements RE making up the following reactive elements of the rare earth type: Hf, Zr, Y, Sr, Ce, La, Si, Yb, Er, and the reactive element Si, with each reactive element being at a content lying in the range 0.05 at % to 0.25 at %.

Furthermore, and preferably, the metal underlayer is of the NiAl(Pt)MRE type (where Pt is a platinum group element) or of the NiAlMRE type (without any element Pt of the platinum group).

Preferably, said metal underlayer also contains as reactive element(s) (RE): 0.05 at %≤Hf≤0.2 at % and/or 0.05 at %≤Y≤0.2 at % and/or 0.05 at %≤Si≤0.2 at %.

More precisely, the metal underlayer contains an NiPtAl type base, as its stabilizer element M only Ag in the range 0.75 at % to 0.9 at %, and as reactive elements 0.08 at %≤Hf≤0.20 at % and/or 0.10 at %≤Y≤0.20 at % and/or 0.15 at %≤Si≤0.25 at %. Under such circumstances, the metal underlayer is of the NiPtAlM(RE) type.

Furthermore, the following provision may advantageously be adopted:

said metal underlayer also contains in the range 5 at % to 36 at % of Al (aluminum), and preferably in the range 8 at % to 25 at % of Al; if the metal underlayer is of the NiPtAlM(RE) type, then it preferably contains in the range 15 at % to 25 at % of Al.

Advantageously, said metal layer presents thickness of less than 20 μm, and preferably of less than 15 μm.

Preferably, said metal underlayer includes a nickel aluminide base and further includes a metal selected from platinum, chromium, palladium, ruthenium, iridium, osmium, rhodium, or a mixture of these metals, and/or one or more reactive elements selected from zirconium (Zr), cerium (Ce), lanthanum (La), strontium (Sr), hafnium (Hf), silicon (Si), ytterbium (Yb), erbium (Er), and yttrium (Y).

In another preferred provision, said metal substrate of the part is made of a nickel-based superalloy.

In particular, said metal substrate is made of a nickel-based superalloy of the AM1 (NTa8CKWA) type.

The invention is not limited to parts with a substrate made of a nickel-based superalloy: a part made of a superalloy based on cobalt may also carry a coating with the composition in accordance with the invention.

The invention also relates to a coating that further comprises a ceramic layer covering said metal underlayer, in order to form a thermal barrier.

In particular, the part of the present invention may form a turbine part for a turbine engine.

In another aspect of the present invention, the part forming a part of a turbine engine is a blade or a vane, in particular a turbine blade or vane, a portion of a nozzle, a portion of an outer shroud or of an inner shroud of a turbine, or a portion of a wall of a combustion chamber.

Other advantages and characteristics of the invention appear on reading the following description made by way of example and with reference to the accompanying drawings, in which.

Figure 1:
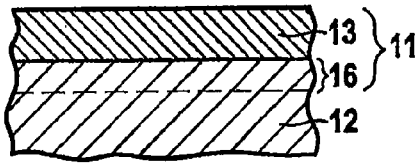
FIG. 1 is a diagrammatic section view showing a portion of a mechanical part coated in a coating.

In a first embodiment, the metal part shown in a fragmentary view in FIG. 1 comprises a coating 11 deposited on a superalloy substrate 12, e.g. a superalloy based on nickel and/or on cobalt. The coating 11 comprises a metal underlayer 13 deposited on the substrate 12. An interdiffusion zone 16 situated at the surface of the substrate 12 is modified in operation by certain elements of the metal underlayer 13 diffusing into the substrate 12.

The bonding underlayer 13 is a metal underlayer constituted by or including a nickel aluminide base optionally containing a metal selected from: platinum, chromium, palladium, ruthenium, iridium, osmium, rhodium, or a mixture of these metals, and/or a reactive element selected from zirconium (Zr), cerium (Ce), strontium (Sr), titanium (Ti), tantalum (Ta), hafnium (Hf), silicon (Si), and yttrium (Y), in particular a metallic underlayer constituted by NiAlPt.

Such a coating 11 is a protective coating used against phenomena of hot oxidation and of corrosion.

In a second embodiment, said coating 11 also comprises a ceramic layer 14 covering said metal underlayer 13.

Figure 2:
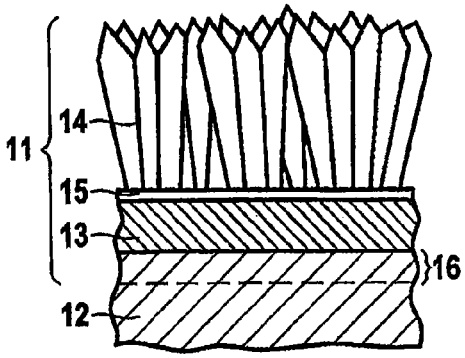
FIG. 2 is a diagrammatic section view showing a portion of a mechanical part coated in a coating forming a thermal barrier.

This is a mechanical part shown partially in FIG. 2 and it has a thermal barrier coating 11 deposited on the superalloy substrate 12, e.g. a superalloy based on nickel and/or on cobalt. The thermal barrier coating 11 comprises a metal underlayer 13 deposited on the substrate 12, and a ceramic layer 14 deposited on the underlayer 13.

The ceramic layer 14 is constituted by an yttrium-stabilized zirconia base having a molar content of yttrium oxide lying in the range 4% to 12% (partially-stabilized zirconia). Under such circumstances, the stabilized zirconia 14 may also contain at least one oxide of an element selected from the group constituted by the rare earths, and preferably from the following subgroup: Y (yttrium), Dy (dysprosium), Er (erbium), Eu (europium), Gd (gadolinium), Sm (samarium), Yb (ytterbium), or a combination of an oxide of tantalum (Ta) and at least one rare earth oxide, or with a combination of an oxide of niobium (Nb) and at least one rare earth oxide.

During fabrication, the bonding underlayer 13 is oxidized prior to depositing the ceramic layer 14, giving rise to the presence of an intermediate layer 15 of alumina between the underlayer 13 and the ceramic layer 14.

In the view of FIG. 2, there can be seen the various layers mentioned above, with a column structure that is typical for the ceramic layer 14 present on the surface.

After being used in service, the part (e.g. a turbine blade or vane) will have been subjected to hundreds of high temperature cycles (at about 1100° C.), and it will present a thermal barrier of morphology that has changed and that ends up by becoming damaged and spalling so that the substrate is no longer protected.

Figure 3:
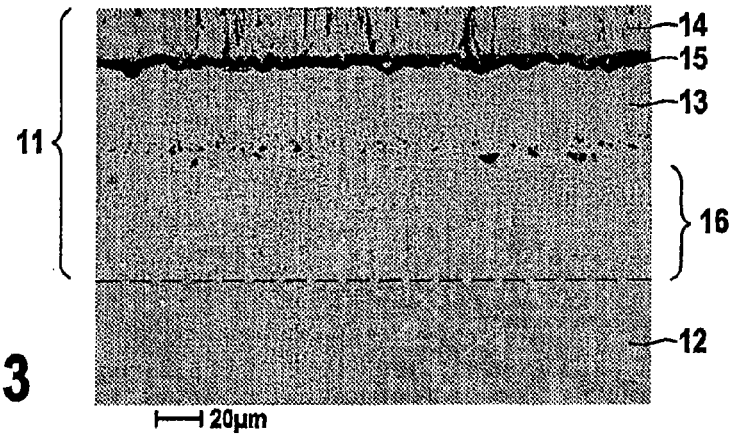
FIGS. 3 and 4 are micrograph sections at two different magnifications showing the various layers of the thermal barrier at the surface of the part, after a cyclic oxidation-resistance test, and with a prior art metal underlayer.
Figure 4:
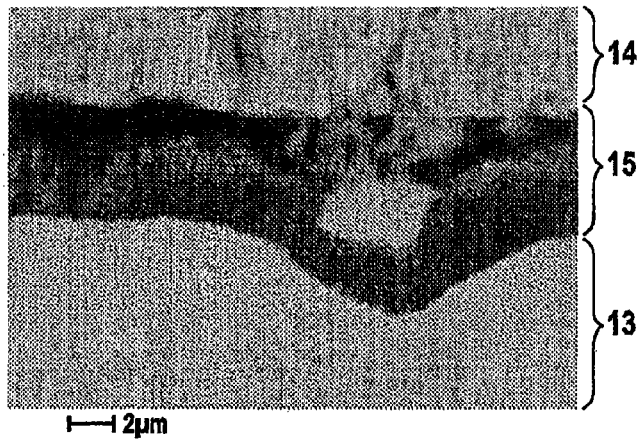
Figure 5:
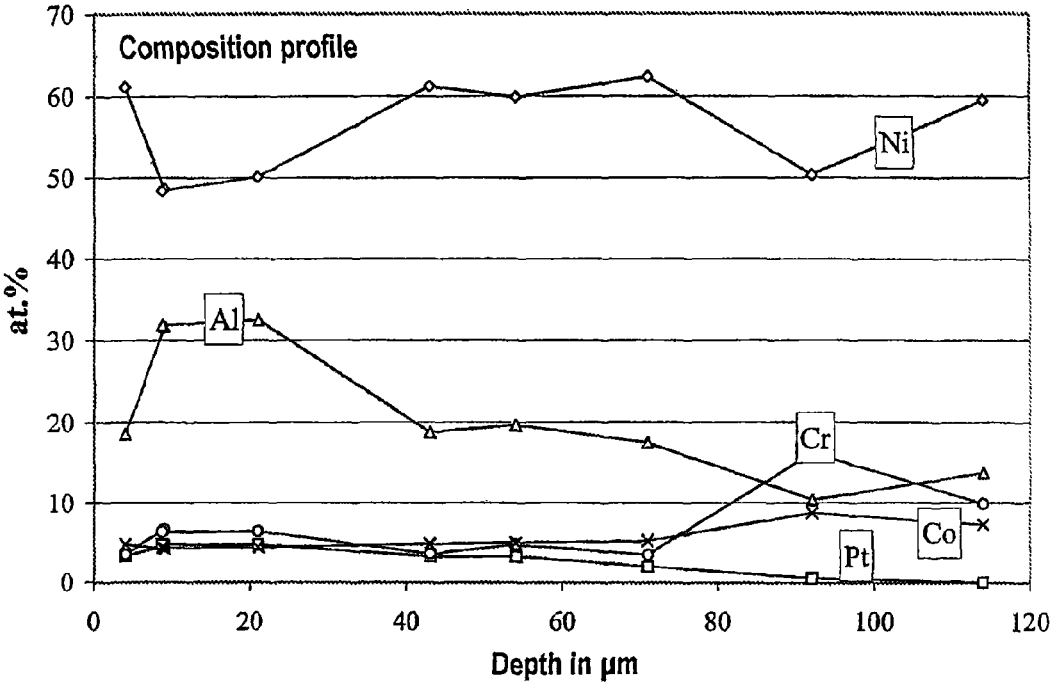
FIG. 5 shows the composition profile of the metal underlayer of the part of FIGS. 3 and 4, as a function of depth.

With reference to FIGS. 3 to 5, the structure of the thermal barrier 11 is shown after 300 one-hour thermal cycles at 1100° C. in air, in order to illustrate the behavior of a prior art thermal barrier when subjected to cyclical oxidation.

This thermal barrier 11 in FIGS. 3 and 4 was deposited on a substrate 12 made of a nickel-based alloy of the AM1 or NTa8GKWA type, and it comprises a metal underlayer 13 of beta phase (Ni,Pt)Al (i.e. β-(Ni,Pt)Al), surmounted by an intermediate layer 15 of alumina ($Al_2O_3$), itself covered in the layer of stabilized zirconia ceramic 14.

Black residues of sand-blasting alumina can be seen in the bottom portion of the metal underlayer 13. This interdiffusion zone 16 situated in contact with the substrate 12 is characterized by precipitates of heavy elements and by topologically close-packed (TCP) phases (pale precipitates of globular and needle shapes). It should be recalled that TCP phases are constituted by precipitates of heavy elements that appear at locations where a large amount of material has diffused, in the interdiffusion zone between the metal underlayer and the substrate.

At higher magnification (FIG. 4), it can be seen that the surface of the metal underlayer 13 is highly irregular. There can also be seen delamination or loss of adhesion at the interface formed between the intermediate alumina layer 15 (or thermally grown oxide (TGO)) and the zirconia layer (outer ceramic layer 14).

Furthermore, the beginning of a beta to gamma prime phase transformation (β→γ') can be seen in the β metal underlayer 13 after 300 cycles (FIG. 3), located at the joints of the β grains. This transformation tends to induce changes of volume and thus make the coating 11 brittle.

Furthermore, it can be seen from the profile of the composition of the metal underlayer 13 (FIG. 5), that the aluminum of the intermediate alumina layer 15 has diffused into the metal underlayer 13, with a significant proportion of aluminum (more than 30 at %) being found at depths in the range 10 μm to 20 μm.

Figure 8:
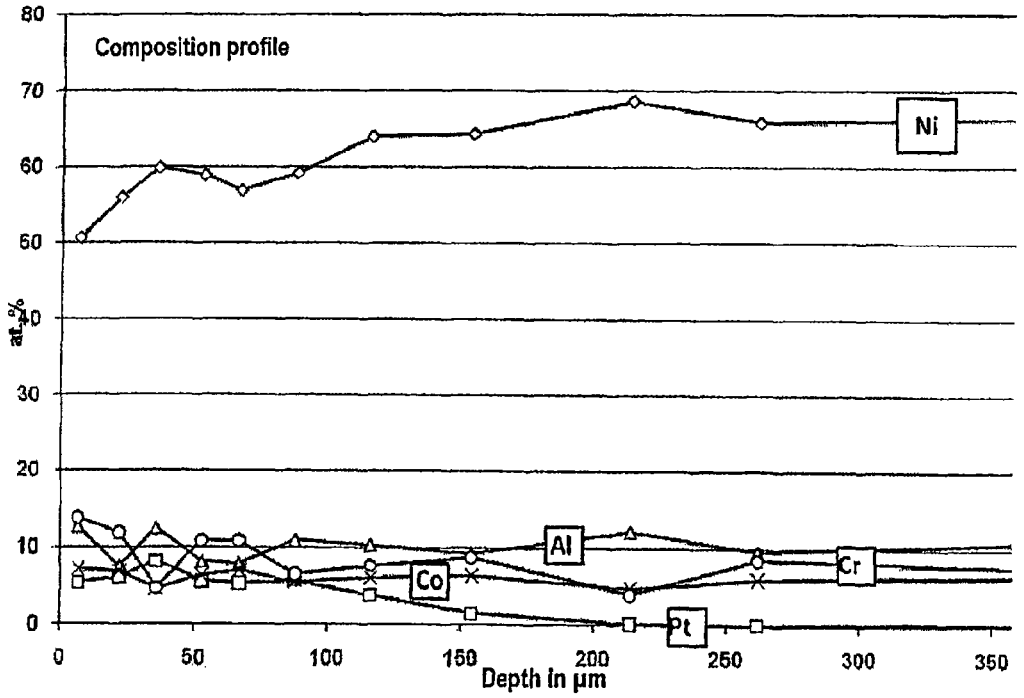
FIG. 8 shows the composition profile of the metal underlayer of the part of FIGS. 6 and 7, as a function of depth.
Figure 6:
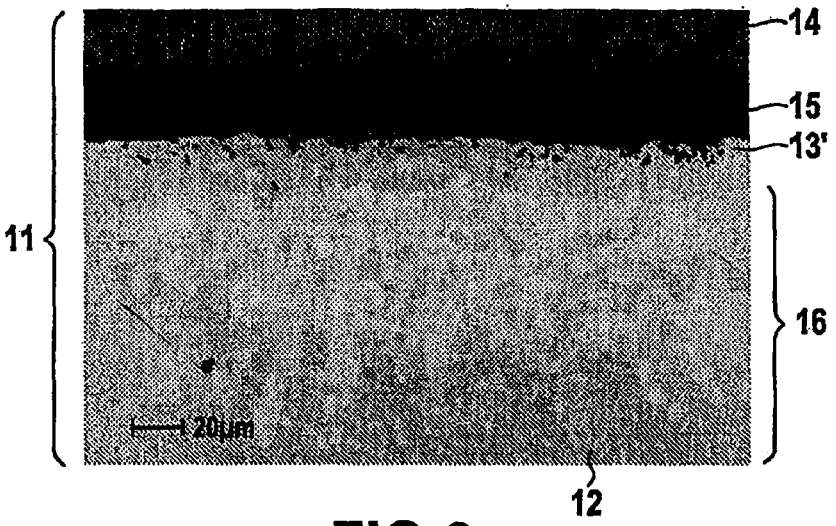
FIGS. 6 and 7 are micrograph sections at two different magnifications showing the various layers of the thermal barrier at the surface of the part after a cyclic oxidation-resistance test, and with a metal underlayer of the invention.
Figure 7:
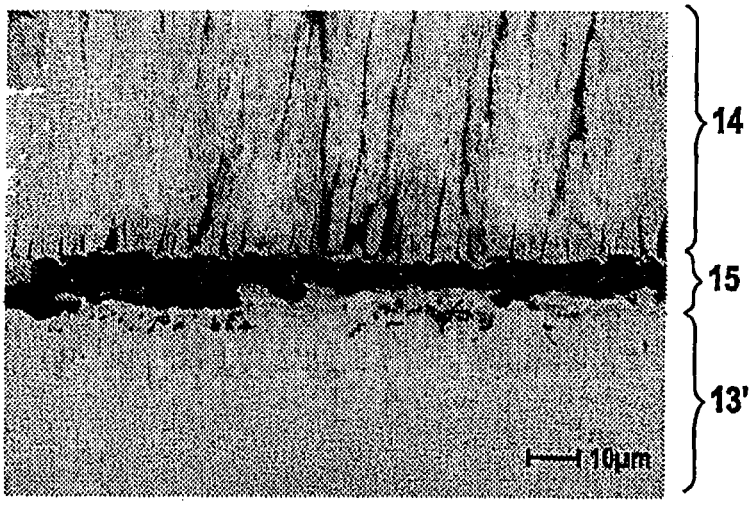

Reference is now made to FIGS. 6 to 8 which correspond respectively to views similar to those of FIGS. 3 to 5, for a coating 11 presenting a metal underlayer 13' and a ceramic layer 14. The only difference lies in the fact that the metal underlayer 13' has the composition of the present invention.

In particular, in this example, it is a metal underlayer 13' of the γ/γ' NiPtAl type (i.e. the gamma/gamma prime NiPtAl type) that has been doped with Hf (0.13 at %), Y (0.15 at %), Si (0.22 at %), and Ag (0.83 at %).

For this purpose, tests were performed using the spark plasma sintering (SPS) technique with foils of pure aluminum and of pure platinum that were stacked on one another. More precisely, the following were stacked on the AM1 substrate one on another and in the following order:

- a 50 nanometer (nm) layer of Si deposited by the high frequency physical vapor deposition (PVD-HF) technique lying directly on the AM1 substrate;
- a 150 nm layer of the element Y that was deposited by the PVD-HF technique;
- a 90 nm layer of the element Hf that was deposited by the PVD-HF technique;
- a 220 nm layer of the element Ag that was deposited by the conventional PVD-HF technique;
- a 10 μm foil of platinum (element Pt); and
- a 2 μm foil of aluminum (element Al).

Thereafter, the stack was subjected to the SPS step that serves not only to consolidate the assembly but also produce interdiffusion of the elements, and then homogenizing annealing was performed for 10 hours (h) at 1100° C.

That was sample E4 in Table 1 below, which gives the compositions of various samples, E3 and E4 being doped with Ag as the stabilizer element M, while E1 and E2 constitute reference samples without a stabilizer element M and with a standard β-(NiPt)Al underlayer. The performance of these four samples was tested under cyclic oxidation over 1000 cycles at 1100° C. in air, and the results are shown in FIGS. 8 and 9.

TABLE 1

| Sample | Pt μm | Al μm | Hf at % (nm) | Y at % (nm) | Si at % (nm) | Ag at % (nm) |
|---|---|---|---|---|---|---|
| E1 | 7 | not measured | <0.05 | 0 | 0 | 0 |
| E2 | 7 | not measured | <0.05 | 0 | 0 | 0 |
| E3 | 4 | 0 | 0.11 (50) | 0.07 (45) | — — | 1.62 (275) |
| E4 | 10 | 2 | 0.13 (90) | 0.15 (150) | 0.22 (50) | 0.83 (220) |

Figure 9:
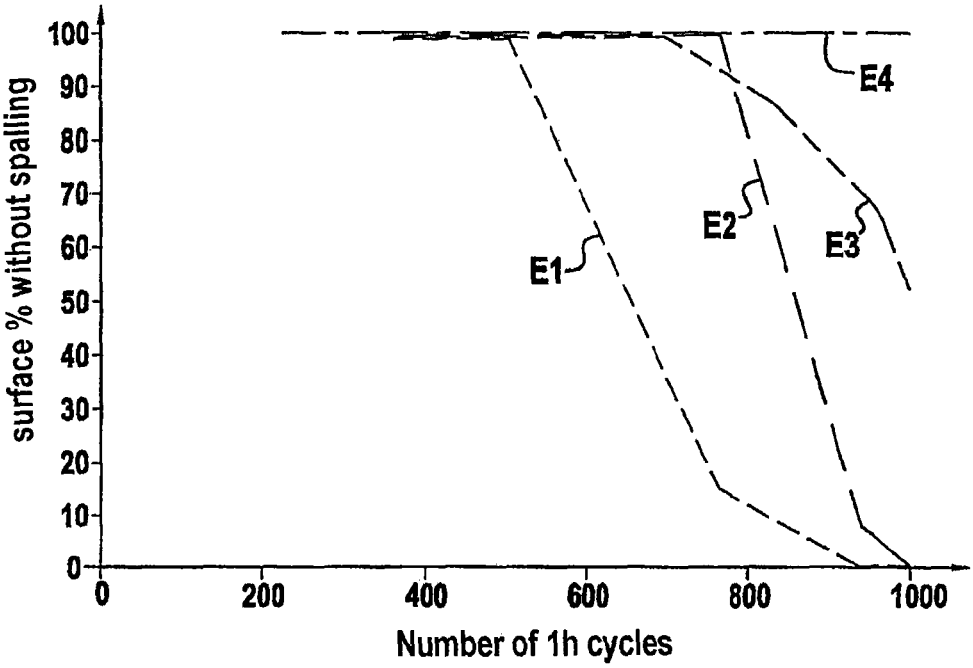
FIGS. 9 and 10 show the ability of various samples to withstand spalling when subjected to thermal cycling (cyclic oxidation at 1100° C. in air).
Figure 10:
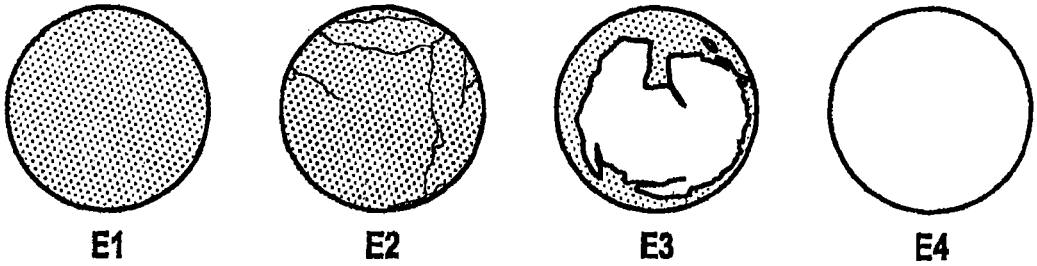

As can be seen in FIGS. 9 and 10, the ability of samples E3 and E4 of the invention to withstand spalling is significantly improved under thermal cycling, since with reference samples E1 and E2 without the stabilizing element, spalling was total after 1000 cycles, whereas for sample E3, 50% of the surface had not yet spalled and for sample E4, 100% of the surface had not yet spalled.

It can be seen that this coating 11 in accordance with the invention does not have TCP phases, with the absence of an interdiffusion zone with numerous precipitates implying a reduction in mechanical stresses in operation.

Furthermore, this coating 11 in accordance with the invention does not have any β→γ' (i.e. beta to gamma prime) phase transformation in the metal underlayer 13'.

Other comparisons were made between the (Ni,Pt)Al beta type metal underlayer 13 and the gamma/gamma prime NiPtAl type metal underlayer 13' presenting the composition in accordance with the invention.

Table 2 shows the contents of platinum and aluminum found in the oxide layer 15 in the metal underlayer 13 or 13' at the specified depths:

TABLE 2

| | β metal underlayer 13 (E2) | γ-γ' metal underlayer 13' (E4) |
|---|---|---|
| [Pt] | 3 at % to 5 at % (γ' or β phase) in the range 0 to 30 μm | 5 at % at 8 μm |
| [Al] | 18 at % to 30 at % (γ' or β phase) in the range 0 to 30 μm | 12 at % at 8 μm |

It can thus be seen that using a metal underlayer 13' with a composition in accordance with the invention prevents the metal underlayer 13' being depleted of aluminum by diffusion to the substrate.

Thus, in the coating 11 in accordance with the invention, after cyclic oxidation at high temperature, it can be seen (see also FIG. 8), that there occurs less interdiffusion of the metal underlayer 13' into the superalloy substrate.

Both metal underlayers 13 and 13' are alumina-forming (FIGS. 4 and 7).

Furthermore, the roughness Ra of the samples in the micrographs in section of the coatings has been calculated and is given in Table 3.

TABLE 3

| Ra (μm) | β metal underlayer 13 (E2) | γ-γ' metal underlayer 13' (E4) |
|---|---|---|
| Before cycling | 0.54 | 0.515 |
| After 1000 cycles | 6.6 | 2 |

The roughness of the metal underlayer 13 increases after 1000 thermal cycles and reveals complete spalling. The roughness of the metal underlayer 13' in accordance with the invention varies little, thereby ensuring that the ceramic layer is well anchored on the underlayer.

The metal underlayer 13' in accordance with the present invention may be made using various deposition techniques.

In particular, it is possible to use various techniques involving one or more steps.

The metal underlayer 13' may be deposited in a single step using the following alternative techniques:

physical vapor deposition (PVD) from a target having the composition desired for the metal underlayer 13';

deposition of the SPS type from a powder presenting the composition desired for the metal underlayer 13' or foils of pure metals, or a foil of the matching composition; and deposition by plasma spraying (e.g. low pressure plasma spraying (LPPS)) using a powder presenting the composition desired for the metal underlayer 13'.

It is also possible to make the metal underlayer 13' using the techniques of the prior art while adding the additional element(s) thereto in one or more additional steps.

In one possible solution, the stabilizer elements M (Cu and/or Ag) are deposited together with any reactive elements RE (Hf, Zr, Y, Sr, Ce, Sr, Si, Er, Yb) by PVD or by SPS, and where applicable platinum group elements (PGE) are deposited electrolytically.

Under such circumstances, it should be understood that all of the additives (RE, M, Pt, Al) should be added before the SPS step. The stack of superposed layers is then subjected to interdiffusion by SPS prior to homogenizing heat treatment.

The invention claimed is:

1. A part comprising a coating on a superalloy metal substrate, the coating comprising a metal underlayer covering the substrate, wherein the metal underlayer comprises a base of nickel aluminide and 0.5 at % to 0.95 at % of Ag for stabilizing gamma and gamma prime phases.

2. The part according to claim 1, wherein the metal underlayer further comprises Cu in the range from 0.5 at % to 0.95 at %.

3. The part according to claim 1, wherein the metal underlayer further comprises a platinum group element in the range from 2 at % to 30 at % to form a metal underlayer with an NiPtAl type base.

4. The part according to claim 1, wherein the metal underlayer further comprises at least one reactive element selected from the group consisting of a reactive element of a rare earth type: Hf, Zr, Y, Sr, Ce, La, Yb, Er, and a reactive element Si, wherein each reactive element has a content of from 0.05 at % to 0.25 at %.

5. The part according to claim 1, wherein the metal underlayer farther comprises, as a reactive element: 0.05 at %≤Hf≤0.2 at %, 0.05 at %≤Y≤0.2 at %, 0.05 at %≤Si≤0.25 at %, or a combination thereof.

6. The part according to claim 1, wherein the metal underlayer comprises:

an NiPtAl type base;

as reactive element 0.08 at %≤Hf≤0.20 at %, 0.10 at %≤Y≤0.20 at %, 0.15 at %≤Si≤0.25 at %, or a combination thereof, wherein the Ag content is from 0.75 at % to 0.9 at %.

7. The part according to claim 1, wherein the metal substrate is made of a nickel-based superalloy.

8. The part according to claim 1, wherein the coating farther comprises a layer of ceramic covering the metal underlayer.

9. The part according to claim 1, forming a turbine part for a turbine engine.

10. The part according to claim 1, constituting a turbine engine blade or vane.

11. The part according to claim 1, wherein the metal underlayer comprises 0.6 at % to 0.9 at % of Ag.

12. The part according to claim 1, wherein the metal underlayer comprises 0.7 at % to 0.85 at % of Ag.

13. The part according to claim 1, wherein the metal underlayer further comprises at least one platinum group element.

14. The part according to claim 1, wherein the metal underlayer has a thickness of less than 20 μm.

15. The part according to claim 1, wherein the metal underlayer has a thickness of less than 15 μm.

16. The part according to claim 1, wherein the metal underlayer further comprises at least one element selected from the group consisting of platinum, chromium, palladium, ruthenium, iridium, osmium and rhodium.

17. The part according to claim 1, wherein the metal underlayer further comprises at least one element selected from the group consisting of zirconium, cerium, lanthanum, strontium, hafnium, silicon, ytterbium, erbium and yttrium.

18. A method of preparing the part according to claim 1, comprising coating the superalloy metal substrate with the coating.

* * * * *